United States Patent [19]

Schreiner

[11] Patent Number: 4,724,628

[45] Date of Patent: Feb. 16, 1988

[54] HEEL JEWELRY

[76] Inventor: Kevin E. Schreiner, 212 E. Capital, Grand Island, Nebr. 68801

[21] Appl. No.: 816,155

[22] Filed: Jan. 3, 1986

[51] Int. Cl.[4] ..... A43B 23/24

[52] U.S. Cl. ..... 36/136; 36/132; 40/2 E; D2/315; 2/245

[58] Field of Search ..... 36/136, 137, 132, 139; 2/244, 245, 246; D2/315; 40/2 E; 411/411, 378, 392, 423, 424, 904–908; 15/208

[56] References Cited

U.S. PATENT DOCUMENTS

| | | | |
|---|---|---|---|
| 1,597,823 | 8/1926 | Randolph | 36/137 |
| 1,751,069 | 3/1930 | Blain | 36/136 |
| 1,933,243 | 10/1933 | DeMerolis et al. | 36/136 |
| 2,194,916 | 3/1940 | Somers | 15/206 |
| 2,319,841 | 5/1943 | Bate | 15/206 |
| 2,399,468 | 4/1946 | Cole | 411/411 |
| 3,972,597 | 8/1976 | Repay et al. | 74/425 |
| 4,402,641 | 9/1983 | Arff | 411/908 |

FOREIGN PATENT DOCUMENTS

| | | | |
|---|---|---|---|
| 958192 | 3/1950 | France | 411/392 |
| 2556190 | 6/1985 | France | 36/136 |
| 113159 | 1/1926 | Switzerland | 40/2 E |
| 23122 | of 1912 | United Kingdom | 36/136 |
| 2077845 | 12/1981 | United Kingdom | 411/908 |

*Primary Examiner*—Werner H. Schroeder
*Assistant Examiner*—Steven N. Meyers
*Attorney, Agent, or Firm*—Berman, Aisenberg & Platt

[57] ABSTRACT

A shoe having jewelry removably attached to the heel is disclosed. The preferred attachment includes a hollow tube which is inserted into a hole in the heel. The tube has an inner helical surface for receiving an anchor. The anchor is an elongate element having flexible fingers extending radially outwardly from the element. The tips of the fingers engage the helical inner surface to secure the anchor. Attached to one end of the anchor is a piece of jewelry, or the like, for adornment of the shoe. The jewelry may be easily removed by removing the anchor from the attachment element. Other pieces of jewelry may be attached, or the hole may be covered by a cover attached to a similar anchor.

6 Claims, 4 Drawing Figures

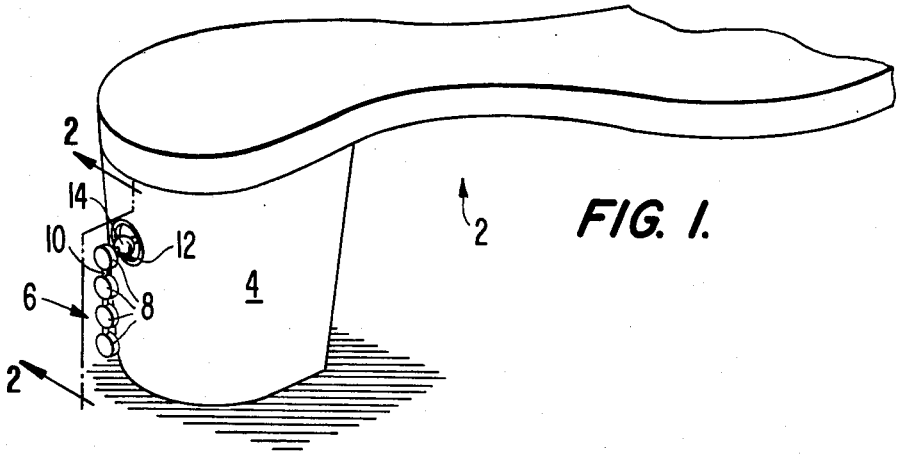
FIG. 1.
FIG. 2.
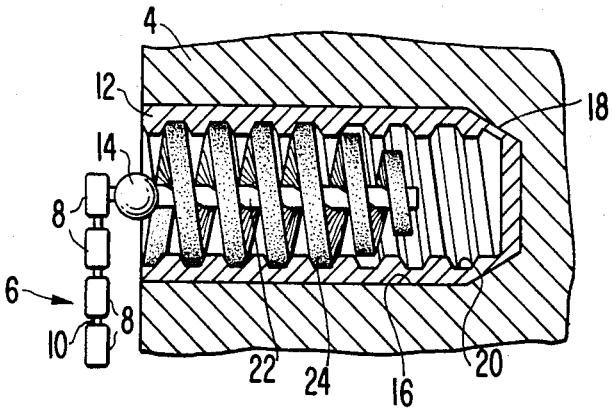
FIG. 3b.
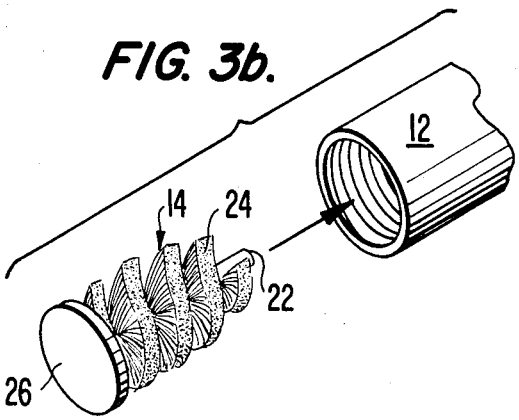
FIG. 3a.
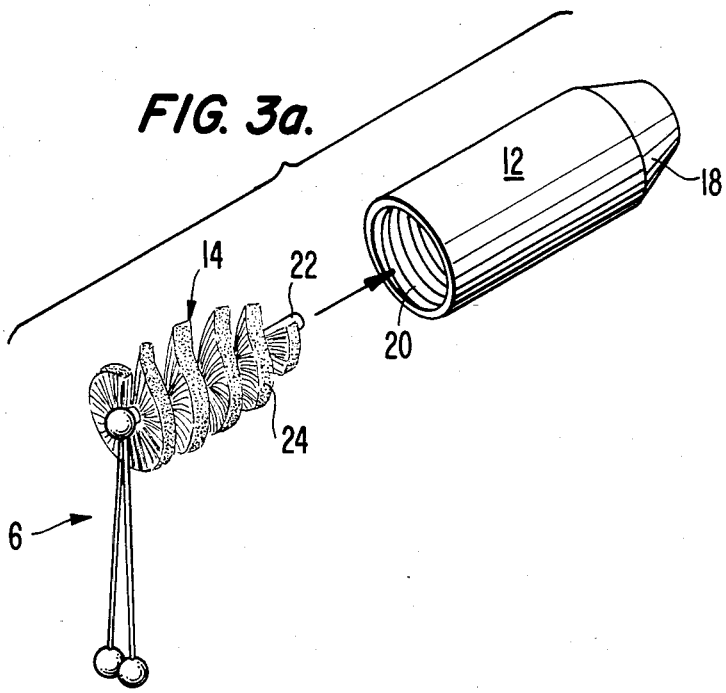

HEEL JEWELRY

TECHNICAL FIELD

This invention relates to the art of shoes. In particular, the invention relates to adornment for the heel of a shoe.

BACKGROUND OF THE INVENTION

It is known to adorn a shoe with such articles as chrome or brass plate. Typically, these are both functional and decorative in that they prevent wear of the shoe at the location of the decorative plate. These plates are permanently attached, for example, by glue or screws.

None of the known adornment for shoes is easily removable or capable of being easily replaced by other adornment. Furthermore, it is not possible to provide a shoe of acceptable appearance when all adornment has been removed.

SUMMARY OF INVENTION

In accordance with the invention, the heel of a shoe is provided with jewelry or other adornment which may be easily removed or replaced. An attachment means is located in the heel for removably receiving an anchor which is attached to the jewelry. The jewelry may be attached to the shoe or removed by simply engaging or disengaging the anchor with the attachment means.

In the preferred embodiment, the attachment means is a small, hollow tube which is embedded in a small hole in the heel of a shoe such that the base of the tube is flush with the surface of the heel. The inner surface of the tube is grooved to receive the anchor means.

The anchor preferably includes an elongate central part surrounded by radially-extending elements which engage the grooves on the inner surface of the attachment means. The jewelry is then attached to the elongate central element and is secured to the heel by simply pressing the anchor means into the attachment means. Removal by a small force directed outwardly is difficult, but because of the helical arrangement of the grooves, a slight twist allows the jewelry to be detached easily.

The jewelry may be applied in any of several combinations. For example, a single piece of jewelry may be secured to the heel by cooperation between a single anchor and attachment means. On the other hand, it may be possible to attach an elongate piece of jewelry by having an anchor means at each end and by inserting each anchor means into a respective attachment means, located at opposite sides of the heel.

If it is desired to have no jewelry attached to the heel, the anchor may simply be detached, and a cover which is secured to another anchor means may be attached to the heel to cover the opening.

It is an object of this invention to provide a shoe wherein means are provided for removably receiving an article of adornment.

Yet another object of this invention is to provide a unique means for attaching jewelry to the heel of a shoe.

BRIEF DESCRIPTION OF THE DRAWINGS

FIG. 1 is a partial perspective of a shoe showing a heel with jewelry thereon.

FIG. 2 is a cross-section taken along line 2—2 of FIG. 1.

FIG. 3*a* is an exploded view of the attachment means and anchor means having jewelry attached.

FIG. 3*b* is similar to FIG. 3*a* showing a cover.

DETAILED DESCRIPTION

FIG. 1 is a partial diagram of a shoe 2 having a heel 4. Attached to the heel is a piece of jewelry 6 which is shown for purpose of illustration as comprising four elements 8 connected by a chain 10. Many other forms of jewelry may be used, the particular ones shown on the drawings being merely illustrative.

Embedded in heel 4 is an attachment element 12 which forms a removable receptacle for an anchor 14 which is attached to jewelry 6.

FIG. 2 is a cross-section taken along line 2—2 of FIG. 1 and shows the preferred structure of the invention in greater detail. Attachment element 12 is a hollow tube received in a hole 16 in shoe 4. Attachment element 12 includes a conical surface 18 to facilitate its insertion into hole 16. The inner surface of attachment element 12 includes a helical groove 20 for a purpose which will be described below. The front of attachment element 12 is preferably flush with the surface of the heel.

Anchor 14 comprises a central elongate element 22 attached to radially-extending fingers 24 which in turn engage helical groove 20 to retain the anchor in the attachment element 12. In the preferred embodiment, central elongate element 22 comprises two twisted wires, and fingers 24 comprise flexible bristles wound in the wires to form a helical screw.

FIG. 3 is an exploded view of attachment element 12, anchor 14, and jewelry 6. A second illustrative embodiment of jewelry 6 is shown in FIG. 3*a*.

It will be appreciated that installation of the anchor means into the attachment means can be made by simply grasping the outer end of central elongate element 22 and forcing the anchor means inwardly such that the fingers 24 engage helical groove 20. Fingers 24 are sufficiently flexible to allow anchor 14 to be inserted and yet to provide resistance to removal of anchor 14. Because of the helical arrangement of groove 20 and fingers 24, insertion may be facilitated by slightly rotating anchor 14 in one direction, and removal may be facilitated by rotating it in the opposite direction.

It will be appreciated that any number of attachment elements 12 and anchors 14 may be used on a single heel 4. For example, an elongate piece of jewelry 6 may have 2 or more anchors thereon, and the attachment elements may be spaced around the heel. This would allow the jewelry to be strung around the heel by placement of each anchor into a respective attachment element.

FIG. 3*b* is an exploded diagram similar to that of FIG. 3*a* showing an anchor 14 having a cover 26 attached. The cover would be used when it is not desired to attach jewelry 6 to heel 4. Cover 26 is held over the opening of attachment element 12 by anchor 14, and is preferably of a shape similar to that of the surface of the shoe immediately adjacent to attachment element 12 and is of the same color as heel 4.

The invention may be readily provided as a kit comprising attachment element 12, a plurality of anchors 14 as shown in FIG. 3*a* having jewelry of various designs attached thereto, and an anchor 14 as shown in FIG. 3*b* having a cover 26. The user may then choose any of the various jewelry styles for use or may choose to have no jewelry and to cover the hole in attachment element 12 by inserting the anchor as shown in FIG. 3*b* with cover 26.

It will be appreciated that a unique shoe having jewelry removably attached thereto has been shown and described. Modifications within a scope of the appended claims will be apparent to those of skill in the art.

We claim:

1. Apparatus comprising an article of adornment attached to anchor means, said anchor means comprising a central elongate element and flexible elements arranged helically extending radially outwardly from said elongate element;

said apparatus further comprising attachment means for removably receiving said anchor means, said attachment means comprising a hollow cylinder having an inner surface comprising a helical groove for engaging said flexible elements to removably secure said anchor means to said attachment means.

2. Apparatus according to claim 1 further comprising a shoe, wherein said hollow cylinder is at least partially embedded in a heel of said shoe.

3. Apparatus according to claim 1 wherein said article of adornment is a disk for covering an outer end of said hollow cylinder.

4. In a shoe having a heel, the improvement comprising means for removably receiving an article of adornment wherein said means for removably receiving comprises attachment means in said heel having a front surface flush with a surface of said heel adjacent to said front surface, and anchor means attached to said article of adornment for being attached to said attachment means, wherein said attachment means comprises a hollow cylinder having an inner surface which comprises grooves, and said anchor means comprises a central, elongate element having flexible elements extending outwardly to engage said grooves.

5. A shoe according to claim 4 wherein said grooves are helical and said flexible elements are arranged helically.

6. A shoe according to claim 5 wherein said central, elongate element comprises two twisted strands of wire having said article of adornment attached to one end.

* * * * *